United States Patent [19]

Kopfle

[11] Patent Number: 4,951,947

[45] Date of Patent: Aug. 28, 1990

[54] GOLF BALL TEEING DEVICE

[76] Inventor: James F. Kopfle, 11803 Mason Plz., Omaha, Nebr. 68154

[21] Appl. No.: 447,182

[22] Filed: Dec. 6, 1989

[51] Int. Cl.[5] ..... A63B 71/00

[52] U.S. Cl. ..... 273/32.5

[58] Field of Search ..... 273/32 B, 32 R, 32 A, 273/32 F, 32.5

[56] References Cited

U.S. PATENT DOCUMENTS

| | | | |
|---|---|---|---|
| 1,863,140 | 6/1932 | Mulvaney | 273/32.5 |
| 1,902,682 | 3/1933 | Walrath | 273/32.5 |
| 2,609,198 | 9/1952 | Armstrong | 273/32 |
| 2,943,856 | 7/1960 | Eimerman | 273/32.5 |
| 3,206,197 | 9/1965 | Miotke | 273/33 |
| 3,312,468 | 4/1967 | Lynch | 273/33 |
| 3,904,200 | 9/1975 | Jackle et al. | 273/32.5 |
| 4,029,314 | 6/1977 | Dalzell | 273/32 R |
| 4,313,604 | 2/1982 | Baxter | 273/32 A |
| 4,526,369 | 7/1985 | Phelps | 273/32 B |
| 4,616,826 | 10/1986 | Trefts | 273/32.5 |
| 4,714,250 | 12/1987 | Henthorn | 273/32.5 |
| 4,819,938 | 4/1989 | Hill | 273/32 B |

*Primary Examiner*—Theatrice Brown

*Attorney, Agent, or Firm*—Zarley, McKee, Thomte, Voorhees & Sease

[57] ABSTRACT

A golf ball teeing device comprising an elongated tubular member having upper and lower ends and which has a housing positioned at the lower end thereof adapted to receive and support a golf ball therein at times. The lower end of the housing is provided with a bottom wall which has a slot formed therein adapted to support a tee therein upon which the golf ball is positioned. A longitudinally slidable shaft is mounted within the tubular member and has a lower end which is adapted to be selectively moved into engagement with the upper portion of the golf ball to maintain the golf ball on the tee as the teeing operation is being accomplished. The device also includes a ground-piercing member designed to penetrate hard or frozen ground. A divot repair tool is also pivotally mounted on the housing to enable divots to be repaired and to also enable the device to be positioned in a substantially upright condition during periods of non-use.

6 Claims, 5 Drawing Sheets

GOLF BALL TEEING DEVICE

Background of the Invention

Persons with bad backs, knees or hips find it extremely difficult to bend over to place a golf tee in the ground and place a golf ball thereon. Additionally, those same persons find it difficult to retrieve the golf ball from the cup after the golf ball has been putted into the cup.

Many different types of devices have been provided for facilitating the placement of a ball on a tee in the ground but they all appear to suffer from certain disadvantages. For example, U.S. Pat. No. 2,609,198 to Armstrong discloses a device for teeing golf balls on tees wherein the ball and tee are supported at the lower end of an elongated tool so that the person utilizing the same does not have to bend over to tee the ball. However, once the ball has been teed, the Armstrong device must apparently be laid on the ground while the golfer is striking the ball which necessarily requires that the person, who has difficulty bending over, is then required to bend over and retrieve the device from the ground which defeats the entire purpose of the device. Additionally, the prior art devices do not have any convenient means for retrieving the ball from the cup once the ball has been putted into the cup. Additionally, the prior art devices do not include any means for creating an opening for the tee in hard or frozen ground.

It is therefore a principal object of the invention to provide a golf ball teeing device.

A further object of the invention is to provide a golf ball teeing device including means at the lower end thereof which may be inserted into the ground to maintain the device in a substantially upright condition as the golfer is striking the golf ball or attending to other duties.

Still another object of the invention is to provide a golf ball teeing device including a golf ball mark or divot repairing device at the lower end thereof which also serves as a support for the device.

Still another object of the invention is to provide a golf ball teeing device which includes a ground piercing member at the lower end thereof which may be used to create a tee opening in hard or frozen ground.

Still another object of the invention is to provide a golf ball teeing device which is adapted so as to be usable to retrieve a golf ball from the golf hole or cup.

Still another object of the invention is to provide a golf ball teeing device which is economical of manufacture, durable in use and refined in appearance.

These and other objects of the present invention will be apparent to those skilled in the art.

Summary of the Invention

Figure 1:
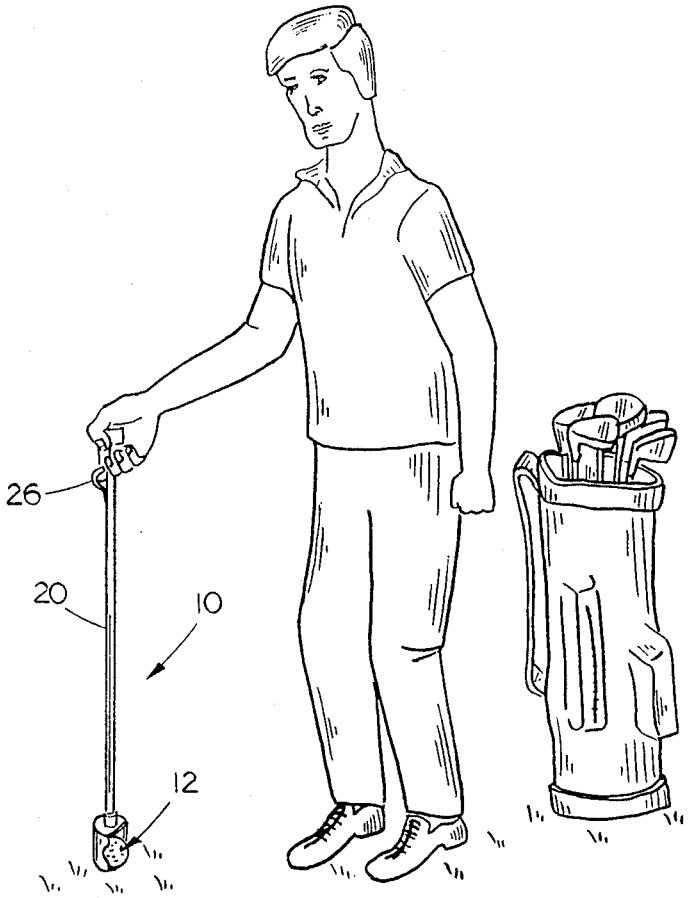
FIG. 1 is a perspective view illustrating a golfer using the device of this invention.
Figure 2:
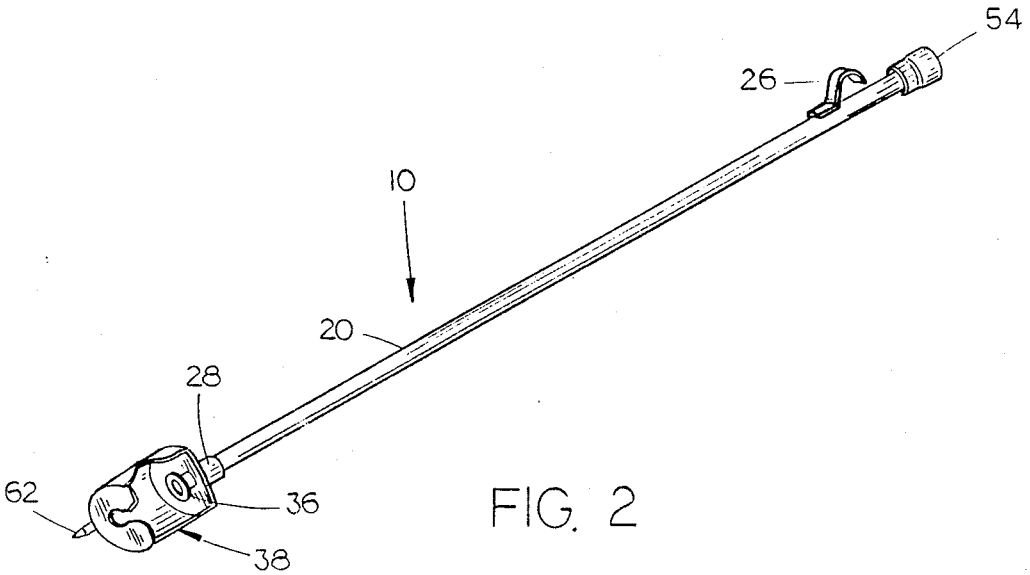
FIG. 2 is a perspective view of the golf ball teeing device of this invention.

The golf ball teeing device of this invention comprises an elongated tubular member having upper and lower ends and which has an elongated shaft longitudinally movably mounted therein with the upper and lower ends of the shaft being exposed at the upper and lower ends of the tubular member. A housing is mounted at the lower end of the tubular member and comprises a semi-circular vertical wall having a bottom wall positioned at the lower end thereof. A slot is formed in the bottom wall which is designed to receive an support a golf tee therein. A golf ball is placed in the housing and is positioned on the tee and clamped thereonto by moving the shaft vertically downwardly with respect to the tubular member. With the ball supported on the tee in the housing, the tee is placed in the ground so that the golf ball is positioned at the proper height. When the golf ball has been properly positioned, the shaft is permitted to move vertically upwardly in the tubular member so as to release the golf ball. The device is then moved laterally with respect to the teed ball. A golf ball mark repair device is pivotally secured to the housing and may be pivotally moved to a downwardly extending position so as to repair all marks or the like. The repair tool may also be used to support the device in an upright condition when not being used so that the golfer does not have to bend over to retrieve the device. Means is also provided at the lower end of the device for creating a tee opening in hard or frozen ground.

Description of the Preferred Embodiment

The golf ball teeing device of this invention is referred to generally by the reference numeral 10 while the reference numeral 12 refers to a conventional golf ball adapted to be positioned on a conventional tee 14 including a shank portion 16 and a head portion 18.

Device 10 includes an elongated tubular member 20 having an upper end 22 and a lower end 24. Finger support 26 is mounted on the exterior surface of tubular member 20 adjacent the upper end thereof as seen in the drawings. Connector 28 including a reduced portion 30 is mounted on the lower end of tubular member 20 by any convenient means to define a shoulder 32.

Shaft or rod 34 is longitudinally, vertically, movably mounted in tubular member 20 and has its upper end positioned above the upper end 22 of tubular member 20. The lower end of shaft 34 extends downwardly through connector 28 and has a ball clamping portion 36 mounted on its lower end.

The numeral 38 refers to a housing secured to the lower end of connector 28 and which includes a top wall 40, vertically disposed semi-circular wall 42 and bottom wall 44. Bottom wall 44 is provided with a slot 46 which extends thereinto and which includes slot portions 48 and 50.

Spring 52 is positioned within tubular member 20 to yieldably urge shaft 34 upwardly with respect to tubular member 20. Handle or grip 54 is mounted on the upper end of shaft 34 for facilitating the movement of the shaft 34 downwardly with respect to tubular member 20 so as to clamp the golf ball 12 onto the tee 14 as will be described in more detail hereinafter.

Figure 7:
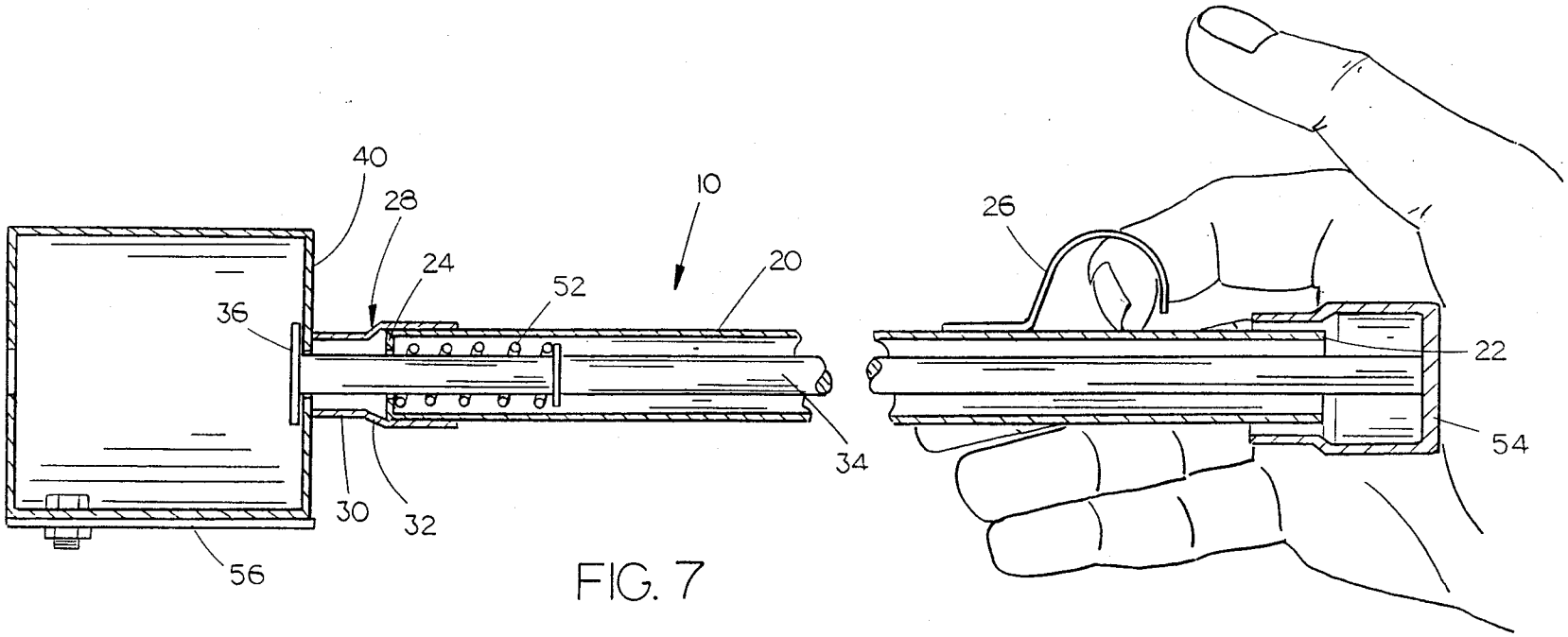
FIG. 7 is a partial sectional view illustrating the device.
Figure 8:
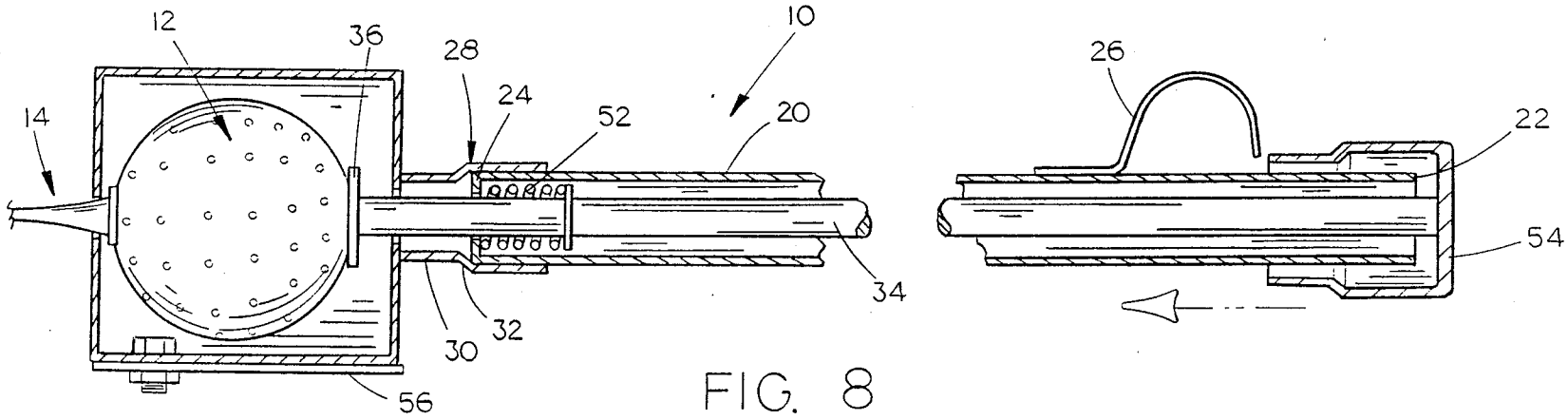
FIG. 8 is a view similar to FIG. 7 except that the device is being used to maintain or hold a ball and tee in the housing.
Figure 9:
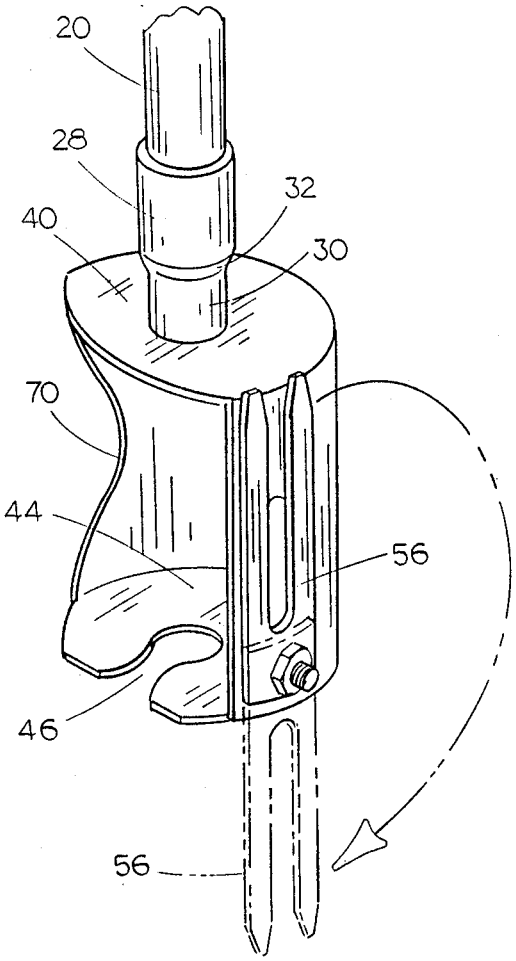
FIG. 9 is a partial perspective view of the lower end of the device with the broken lines illustrating the ball mark or divot repair tool pivotally moved downwardly to an operative position.
Figure 10:
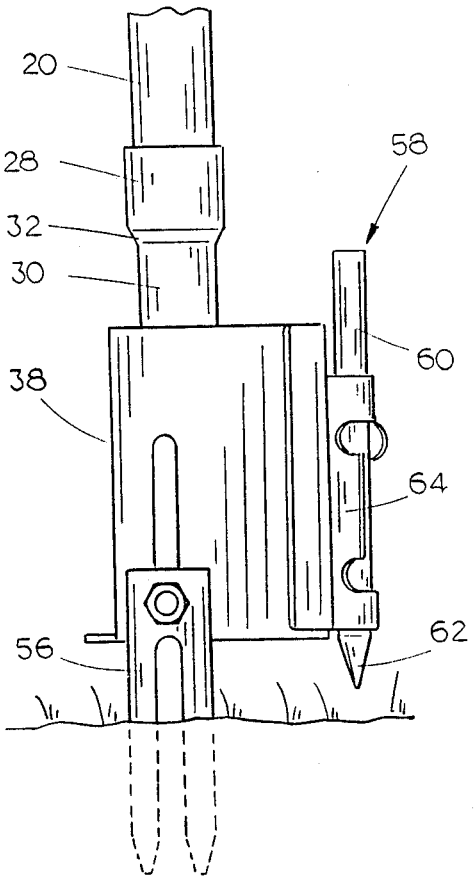
FIG. 10 is a side view illustrating the device being supported in a substantially upright position by the ball mark or divot repair tool having been inserted into the ground.

Ball mark repair tool 56 is selectively, pivotally, movably mounted on the housing 38 and is movable between an inoperative position illustrated in FIG. 7 to the operative position illustrated in FIG. 9. When the repair tool 56 is positioned in its operative position, the tool 56 may be used to repair divots, ball marks, etc. An extremely important facet of the repair tool 56 is that the tool 56, when in its operative position, may be inserted into the ground to support the device in an upright condition, as seen in FIG. 10, during periods of non-use such as when the golfer is striking the ball or tending to other tasks.

Figure 3:
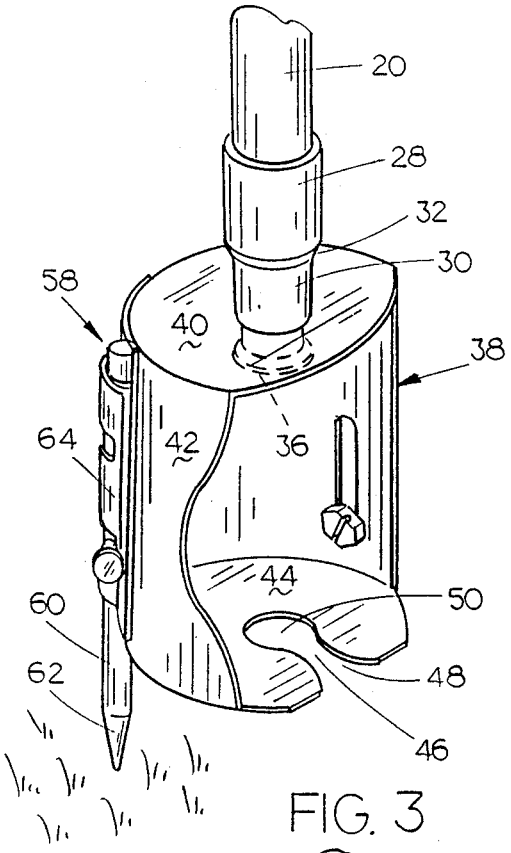
FIG. 3 is a perspective view of the lower end of the device.
Figure 4:
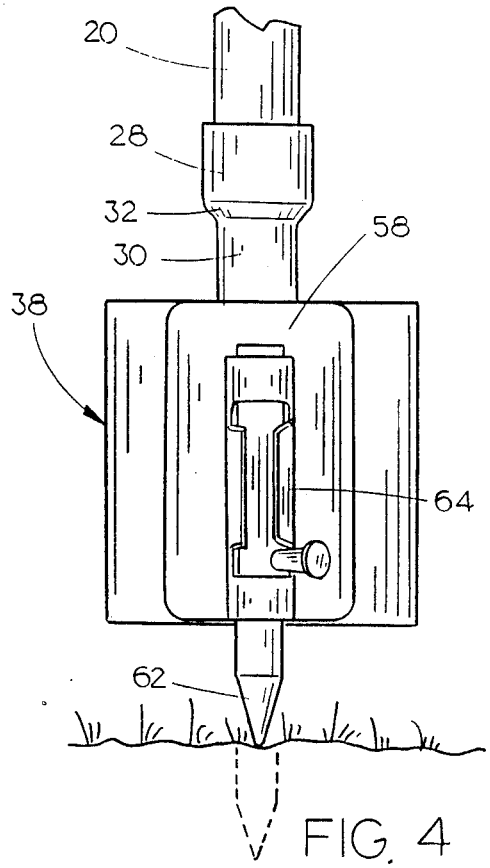
FIG. 4 is a side view of the lower end of the device illustrating the device being used to create an opening in hard or frozen ground.
Figure 5:
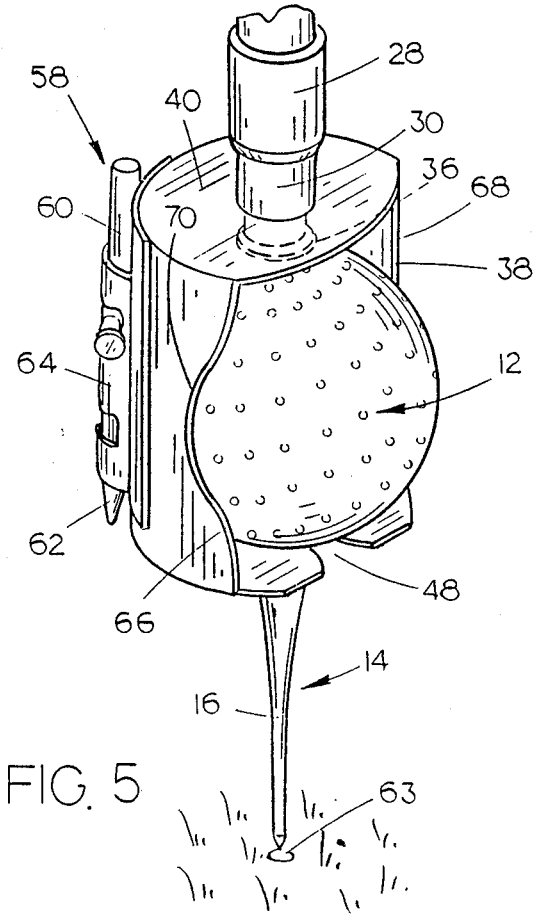
FIG. 5 is a perspective view of the lower end of the device illustrating the device being used to place a tee in the ground and a ball on the tee.
Figure 6:
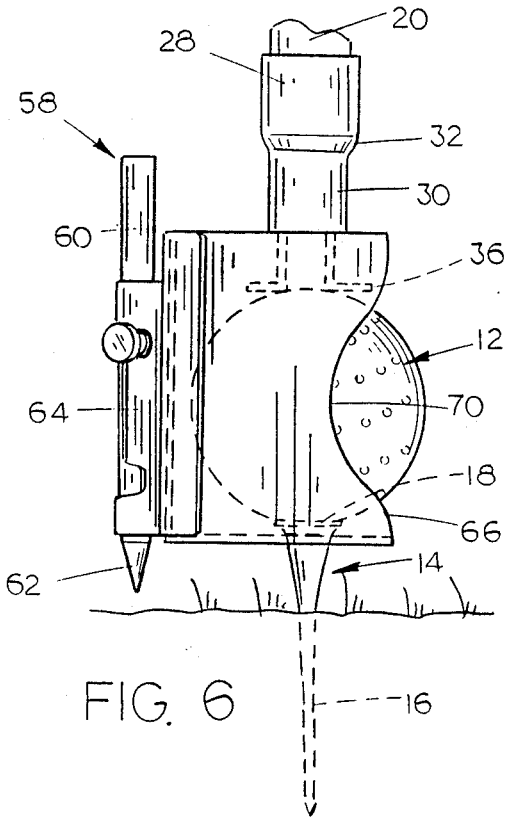
FIG. 6 is aside elevational view of the device illustrating the tee having been placed into the ground with the ball resting thereon but before the device has been removed from the ball.

The numeral 58 refers to a ground piercing device including a selectively vertically movable plunger or shaft 60 having a pointed lower end 62. Shaft 60 is mounted in barrel 64 and may be selectively positioned in the operative position illustrated in FIGS. 3 and 4 or the inoperative position illustrated in FIG. 6. When shaft 60 is positioned in the operative device, the golfer may place his/her foot on the upper end thereof to force the pointed lower end 62 of shaft 60 into the ground to create an opening 63 for a golf tee such as when the ground is hard or frozen. When not needed, device 58 is stored in its inoperative position.

Housing 38 includes a pair of vertically disposed side edges 66 and 68, one of which preferably has an arcuate recessed portion 70 formed therein which facilitates the removal of a golf ball from the golf hole or cup once the ball has been putted into the hole.

In use, tee 14 is inserted into the slot 46 so that the head portion 18 dwells in slot portion 50. Golf ball 12 is then placed in housing 38 so as to rest on the tee 14. Shaft 34 is then moved vertically downwardly with respect to tubular member 20 so that ball clamping portion 36 engages the upper end of the ball to maintain the ball on the tee. Tee 14 is then placed in the ground by moving the device vertically downwardly with respect to the ground so that the lower end or shank portion 16 of the tee pierces the ground to the proper depth. When the tee has been properly positioned, shaft 34 is permitted to move upwardly relative to tubular member 20 so that ball clamping portion 36 moves out of engagement with the ball 12. The device is then moved laterally with respect to the teed ball so that the ball may be struck. Repair tool 56 may be pivotally moved to its operative position and inserted into the ground to maintain the device in an upright condition so that the golfer will not have to bend over to retrieve the device from the ground after the ball has been struck. Tool 56 may also be used to repair ball marks or divots. Ground piercing device 58 may be employed as discussed above to create an opening for the tee 14 in hard or frozen ground.

Figure 11:
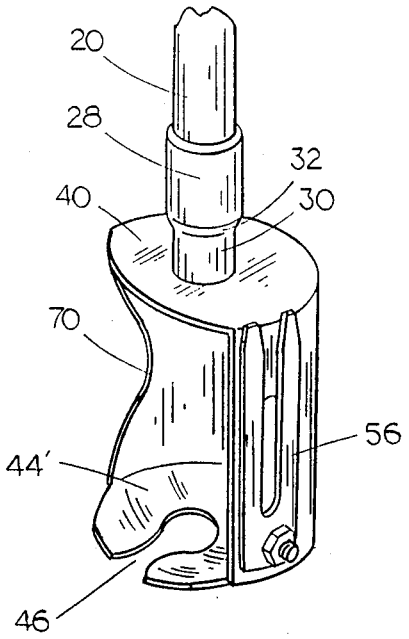
FIG. 11 is a partial perspective view of a modified form of the device.

When the ball has been putted into the cup or hole, housing 38 may be inserted downwardly into the cup and rotated about a vertical axis so that the ball will enter the interior of the housing 38 and which is facilitated by the arcuate recess portion 70 in one of the side edges. The modified form of the invention illustrated in FIG. 11 is especially well adapted to permit the device to be used to remove a ball from the cup. The device illustrated in FIG. 11 is identical to that previously described except that the bottom wall 44 is concave so as to more closely conform to the lower end of the cup liner which facilitates the bottom wall 44' to be moved beneath the ball resting in the cup.

Thus, it can be seen that a novel golf ball teeing device has been described which accomplishes at least all of its stated objectives.

I claim:

1. A golf ball teeing device, comprising, an elongated hollow tubular member having upper and lower ends, an elongated shaft means longitudinally movably mounted in said tubular member, and having an upper end positioned above the upper end of said tubular member and a lower end positioned below the lower end of said tubular member, a housing mounted on the lower end of said tubular member including an arcuate vertical wall having an opening at one side thereof and a bottom wall at the lower end of said vertical wall, said opening being sufficiently large so as to permit the passage of a golf ball therethrough, said bottom wall having a slot formed therein extending thereinto from the opening side of said housing to permit a golf tee to be positioned therein and supported thereby, said slot having a width such that the shank of the golf tee may pass therethrough but which will not permit the head of the golf tee to pass therethrough, a ball engaging means at the lower end of said shaft means for selectively clamping a golf ball onto the head portion of the tee whereby the tee may be inserted into the ground by moving the device downwardly to cause the tee to be inserted into the ground, and a first ground, piercing member pivotally mounted on said housing and longitudially movable between an inoperative retrasted position and an operative extended position whereby said first ground piercing member may be inserted into the ground to support the device in an upright position.

2. The device of claim 1 wherein said ground piercing member comprises a ground repair tool.

3. The device of claim 1 wherein a second ground piercing member is selectively vertically mounted on said housing between operative and inoperative positions, said second ground piercing member having a lower end disposed below and laterally of said bottom wall when in its said operative position for creating a hole in the ground to receive a golf tee therein.

4. The device of claim 3 wherein said second ground piercing member includes means at the upper end thereof whereby the user may place his/her foot thereon to force said second ground piercing member into the ground.

5. The device of claim 1 wherein said vertical wall includes a pair of vertically disposed side edges, at least one of said side edges having an arcuate recessed position formed therein.

6. The device of claim 1 wherein said bottom wall is concave shaped.

* * * * *